US011533987B2

(12) United States Patent
Choi

(10) Patent No.: US 11,533,987 B2
(45) Date of Patent: Dec. 27, 2022

(54) FOLDABLE TABLE WITH AUXILIARY SUPPORT

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 0 days.

(21) Appl. No.: 17/368,253

(22) Filed: Jul. 6, 2021

(65) Prior Publication Data

US 2022/0022643 A1 Jan. 27, 2022

(30) Foreign Application Priority Data

Jul. 21, 2020 (CN) ..... 202021448548.X
Aug. 27, 2020 (CN) ..... 202021830037.4

(51) Int. Cl.
*A47B 3/087* (2006.01)

(52) U.S. Cl.
CPC ..... *A47B 3/087* (2013.01)

(58) Field of Classification Search
CPC ..... A47B 3/087; A47B 3/091
USPC ..... 108/132, 127, 169
See application file for complete search history.

(56) References Cited

U.S. PATENT DOCUMENTS 737,455 A * 8/1903 Noble ..... A47B 3/087 108/168
922,179 A * 5/1909 Nolan ..... A47B 3/087 108/168
1,063,642 A 6/1913 Birdsell
1,911,750 A * 5/1933 Collignon ..... A47B 3/087 108/36
2,136,569 A 11/1938 Trimpi
2,325,182 A * 7/1943 Fitzpatrick ..... E05D 3/12 108/77
2,730,418 A * 1/1956 Blink ..... A47B 3/087 108/169
2,766,089 A * 10/1956 Nielsen ..... A47B 3/087 108/169
2,803,033 A 8/1957 Rachman
(Continued)

FOREIGN PATENT DOCUMENTS

CN 109431070 A 3/2019
EP 1492432 B1 10/2016
(Continued)

*Primary Examiner* — Jose V Chen
(74) *Attorney, Agent, or Firm* — Morgan, Lewis & Bockius LLP

(57) ABSTRACT

A foldable table includes a supporting frame, tabletop and auxiliary support. The supporting frame includes first and second mounting assemblies pivotally connected to each other. The tabletop includes first and second panels coupled with the first and second mounting assemblies such that the first and second panels are rotatable with respect to each other between a folded position and an unfolded position. The auxiliary support includes an auxiliary bar and one or more linking assemblies. The auxiliary bar is coupled with the supporting frame, and each of one or more linking assemblies is coupled with the first and second panels. When the first and second panels are in the unfolded position, each of the one or more linking assemblies abuts the auxiliary bar toward the first and second panels. As such, the auxiliary support provides support to the first and second panels and enhances stability of the foldable table.

20 Claims, 11 Drawing Sheets

(56) References Cited

U.S. PATENT DOCUMENTS

| | | | | | |
|---|---|---|---|---|---|
| 2,811,400 | A | * | 10/1957 | James | A47B 5/06 108/174 |
| 3,075,809 | A | | 1/1963 | Wilson | |
| 3,080,834 | A | * | 3/1963 | Risdall | A47B 3/087 108/169 |
| 3,140,674 | A | * | 7/1964 | Cisler | A47B 83/04 312/277 |
| 3,304,891 | A | | 2/1967 | Rachman | |
| 3,368,504 | A | | 2/1968 | Cohen | |
| 3,410,232 | A | | 11/1968 | Bills | |
| 4,191,111 | A | | 3/1980 | Emmert | |
| 4,489,661 | A | * | 12/1984 | Fitzgerald | A47B 3/083 108/115 |
| 5,325,794 | A | | 7/1994 | Hontani | |
| 6,508,262 | B1 | | 1/2003 | Takayama | |
| 6,752,091 | B2 | | 6/2004 | Glover | |
| 6,843,183 | B2 | | 1/2005 | Strong | |
| 7,059,254 | B2 | | 6/2006 | Strong et al. | |
| 7,096,799 | B2 | | 8/2006 | Strong et al. | |
| 7,097,380 | B2 | | 8/2006 | Lee | |
| 7,171,910 | B2 | | 2/2007 | Neunzert et al. | |
| 7,428,872 | B2 | | 9/2008 | Strong et al. | |
| 7,475,643 | B2 | | 1/2009 | Haney et al. | |
| 7,475,644 | B2 | | 1/2009 | Strong et al. | |
| 7,634,969 | B2 | | 12/2009 | Neunzert et al. | |
| 7,640,870 | B2 | | 1/2010 | Strong et al. | |
| 7,644,667 | B2 | | 1/2010 | Strong et al. | |
| 7,735,431 | B2 | | 6/2010 | Neunzert et al. | |
| 7,874,303 | B2 | | 1/2011 | Xie | |
| 8,006,630 | B2 | | 8/2011 | Strong et al. | |
| 8,033,228 | B2 | | 10/2011 | Haney et al. | |
| 8,042,475 | B2 | | 10/2011 | Larcom et al. | |
| 8,156,875 | B2 | | 4/2012 | Neunzert et al. | |
| 8,166,894 | B1 | | 5/2012 | Branch | |
| 8,302,541 | B2 | | 11/2012 | Haney et al. | |
| 8,342,107 | B2 | | 1/2013 | Mover et al. | |
| 8,534,205 | B1 | | 9/2013 | Johnson et al. | |
| 8,578,865 | B2 | | 11/2013 | Haney et al. | |
| 8,622,007 | B2 | | 1/2014 | Peery et al. | |
| 8,746,155 | B2 | | 6/2014 | Haney et al. | |
| 8,757,069 | B2 | | 6/2014 | Peery et al. | |
| 9,027,952 | B2 | | 5/2015 | Zhu | |
| D748,418 | S | | 2/2016 | Johnson et al. | |
| 9,277,808 | B2 | | 3/2016 | Cai et al. | |
| D756,694 | S | | 5/2016 | Johnson et al. | |
| 9,351,563 | B2 | | 5/2016 | Bennett et al. | |
| 9,462,880 | B1 | * | 10/2016 | Lin | A47B 3/087 |
| 10,470,561 | B2 | | 11/2019 | Clegg et al. | |
| 10,602,852 | B2 | * | 3/2020 | Choi | A47C 19/024 |
| 2003/0089286 | A1 | | 5/2003 | Wang | |
| 2004/0187749 | A1 | | 9/2004 | Zhurong | |
| 2005/0097829 | A1 | | 5/2005 | Seo | |
| 2005/0120923 | A1 | * | 6/2005 | Sagol | A47B 3/083 108/130 |
| 2006/0062632 | A1 | | 3/2006 | Jang | |
| 2007/0101910 | A1 | * | 5/2007 | Haimoff | A47B 3/14 108/169 |
| 2008/0078310 | A1 | | 4/2008 | VanNimwegen | |
| 2013/0000528 | A1 | | 1/2013 | Jin | |
| 2013/0025507 | A1 | | 1/2013 | Jin | |
| 2013/0233210 | A1 | | 9/2013 | Jin | |
| 2014/0030012 | A1 | | 1/2014 | Lee | |
| 2014/0099155 | A1 | | 4/2014 | Chen | |
| 2014/0130837 | A1 | | 5/2014 | Sy-Facunda | |
| 2014/0345506 | A1 | | 11/2014 | Clegg | |
| 2016/0227919 | A1 | | 8/2016 | Turner | |
| 2016/0348395 | A1 | | 12/2016 | Jin | |
| 2017/0013955 | A1 | | 1/2017 | Lin | |
| 2018/0153302 | A1 | | 6/2018 | Jiang | |
| 2019/0150608 | A1 | | 5/2019 | Johnson et al. | |
| 2019/0284831 | A1 | | 9/2019 | Volin | |
| 2019/0292808 | A1 | | 9/2019 | Dotterweich | |
| 2020/0390233 | A1 | * | 12/2020 | Leng | A47C 4/04 |
| 2021/0222823 | A1 | * | 7/2021 | Choi | A47B 3/087 |
| 2021/0345776 | A1 | | 11/2021 | Choi | |

FOREIGN PATENT DOCUMENTS

| | | | | | |
|---|---|---|---|---|---|
| GB | 2192534 | A | * | 1/1988 | A47C 11/00 |
| WO | WO 2011097404 | A1 | | 8/2011 | |
| WO | WO 2013000149 | A1 | | 1/2013 | |

* cited by examiner

FOLDABLE TABLE WITH AUXILIARY SUPPORT

CROSS-REFERENCE TO RELATED APPLICATIONS

The present application claims priority to Chinese Utility Model Applications CN 202021448548.X filed Jul. 21, 2020 and CN 202021830037.4 filed Aug. 27, 2020. The disclosure of each application is incorporated herein for all purposes by reference in its entirety.

FIELD OF THE INVENTION

The present invention generally relates to foldable tables and, in particular, to foldable tables with auxiliary supports.

BACKGROUND

Foldable tables are popular because they require less storage space and are easy to carry around. An existing foldable table generally includes two panels coupled to a supporting frame. However, many exiting foldable tables lack a support between the two panels, making them susceptible to deformation, misalignment or dislocation. For instance, under a load, one panel may shift its position, resulting in a gap or a height difference between the two panels. This not only affects the appearance of the table but also can pinch hands or cause other safety issues. In addition, most exiting foldable tables are relatively small and cannot accommodate more people when needed.

Given the current state of the art, there remains a need for foldable tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides foldable tables with auxiliary supports configured to help stabilize tabletops when the tables are in use.

In various exemplary embodiments, the present disclosure provides a foldable table including a tabletop, a supporting frame, and an auxiliary support. The tabletop includes a first panel and a second panel. Each of the first and second panels includes an upper side and a lower side. The supporting frame is configured to support the first and second panel. The supporting frame includes a first mounting assembly connected to the lower side of the first panel, and a second mounting assembly connected to the lower side of the second panel. The first and second mounting assemblies are pivotally coupled with each other at their proximal sides such that the first and second panels are rotatable with respect to each other between a folded position and an unfolded position. The auxiliary support is configured to assist in supporting and stabilizing the first and second panels when they are in the unfolded position. The auxiliary support includes an auxiliary bar and one or more linking assemblies. The auxiliary bar is disposed between the first and second mounting assemblies in a first direction of the foldable table, and coupled with the first and second mounting assemblies. The auxiliary bar is elongated in a second direction of the foldable table that is substantially perpendicular to the first direction. Each of the one or more linking assemblies includes first, second and third linking pieces. The first linking piece is fixedly coupled with the proximal side of the first panel. The second linking piece is fixedly coupled with the proximal side of the second panel. The third linking piece includes a first portion pivotally coupled with the first linking piece, a second portion pivotally coupled with the second linking piece, and a third portion between the first and second portion. When the first and second panels are in the unfolded position, each of the one or more linking assemblies abuts the auxiliary bar toward the first and second panels, thereby providing support to the proximal sides of the first and second panels and enhancing stability of the foldable table at the proximal sides of the first and second panels.

In some exemplary embodiments, each of the first and second mounting assemblies includes a first mounting bar disposed at a first side of the foldable table and a second mounting bar disposed at a second side of the foldable table. The first mounting bars of the first and second mounting assemblies are pivotally coupled with each other at their proximal ends by a first connector. The second mounting bars of the first and second mounting assemblies are pivotally coupled with each other at their proximal ends by a second connector. The auxiliary bar has a first end fixedly coupled with the first connector and a second end fixedly coupled with the second connector.

In some exemplary embodiments, the supporting frame further includes a first leg assembly connected with the first mounting assembly, and a second leg assembly connected with the second mounting assembly. When the first and second panels are in the folded position, the first and second leg assemblies and the first and second mounting assemblies are disposed between the first and second panels.

In an exemplary embodiment, the one or more linking assemblies include first linking assembly and a second linking assembly spaced apart along the second direction of the foldable table.

In some exemplary embodiments, the third portion of the third linking piece abuts the auxiliary bar toward the first and second panels when the first and second panels are in the unfolded position.

In some exemplary embodiments, the first, second and third linking pieces collectively forms a receptacle to receive, cross-sectional-wise, a portion of the auxiliary bar.

In an exemplary embodiment, a bottom of the receptacle is substantially flat.

In some exemplary embodiments, an edge adjacent to an opening of the receptacle is curved outwardly.

In some exemplary embodiments, a respective linking piece in the first and second linking pieces includes a fourth portion and a fifth portion. The fourth portion of the respective linking piece is fixedly connected to a corresponding panel in the first and second panels. The fifth portion of the respective linking piece is pivotally connected to a corresponding portion in the first and second portions of the third linking piece.

In an exemplary embodiment, the fourth portion of the respective linking piece is fixedly connected to the corresponding panel by a fastener.

In some exemplary embodiments, the corresponding panel includes a recess at the lower side of the corresponding panel to receive the fourth portion of the respective linking piece.

In an exemplary embodiment, the fourth and fifth portions of the respective piece are substantially perpendicular to each other.

In some exemplary embodiments, a cross-section of the auxiliary bar is substantially rectangular.

In some exemplary embodiments, the auxiliary support further includes a third leg assembly coupled with the auxiliary bar of the auxiliary support. When the first and second panels are in the unfolded position, the third leg assembly provides support to the first and second panels. When the first and second panels are in the folded position, the third leg assembly is disposed between the first and second panels.

In some exemplary embodiments, each of the first and second panels includes a first notch formed at its distal side. When the first and second panels are in the folded position, the first notches of the first and second panels face each other and collectively form a gap.

In some exemplary embodiments, the foldable table further includes a handle. The handle is connected to the supporting frame or tabletop to facilitate carrying of the foldable table.

In an exemplary embodiment, the handle is connected to a side of the first panel. A second notch is formed at a side of the second panel. When the first and second panels are in the folded position, the handle and the second notch are adjacent to each other.

In various exemplary embodiments, the present disclosure provides a foldable table including a tabletop, a supporting frame and an auxiliary support. The tabletop includes a first panel and a second panel. Each of the first and second panels includes an upper side and a lower side. The supporting frame is configured to support the first and second panel. The supporting frame includes a first mounting assembly connected to the lower side of the first panel, and a second mounting assembly connected to the lower side of the second panel. The first and second mounting assemblies are pivotally coupled with each other at their proximal sides thereof such that the first and second panels are rotatable with respect to each other between a folded position and an unfolded position. The auxiliary support is configured to assist in supporting and stabilizing the first and second panels when they are in the unfolded position. The auxiliary support includes an auxiliary bar disposed between the first and second mounting assemblies in a first direction of the foldable table. The auxiliary bar is coupled with the first and second mounting assemblies. Also, the auxiliary bar is elongated in a second direction of the foldable table that is substantially perpendicular to the first direction. The auxiliary support also includes a first linking assembly and a second linking assembly spaced apart along the second direction of the foldable table. Each of the first and second linking assemblies is coupled with a proximal side of the first panel and a proximal side of the second panel. When the first and second panels are in the unfolded position, each of the first and second linking assemblies abuts the auxiliary bar toward the first and second panels, thereby providing support to the proximal sides of the first and second panels and enhancing stability of the foldable table at the proximal sides of the first and second panels.

In some exemplary embodiments, each of the first and second mounting assemblies includes a first mounting bar disposed at a first side of the foldable table and a second mounting bar disposed at a second side of the foldable table. The first mounting bars of the first and second mounting assemblies are pivotally coupled with each other at proximal ends thereof by a first connector. The second mounting bars of the first and second mounting assemblies are pivotally coupled with each other at proximal ends thereof by a second connector. The auxiliary bar has a first end fixedly coupled with the first connector and a second end fixedly coupled with the second connector.

In some exemplary embodiments, the present disclosure provides a foldable table including a tabletop, a supporting frame and an auxiliary support. The tabletop includes a first panel and a second panel. Each of the first and second panels includes an upper side and a lower side. The supporting frame is configured to support the first and second panel. The supporting frame includes a first mounting assembly connected to the lower side of the first panel and a second mounting assembly connected to the lower side of the second panel. The first and second mounting assemblies are pivotally coupled with each other at their proximal sides such that the first and second panels are rotatable with respect to each other between a folded position and an unfolded position. The supporting frame also includes a first leg assembly connected with the first mounting assembly, and a second leg assembly connected with the second mounting assembly. The auxiliary support is configured to assist in supporting and stabilizing the first and second panels when they are in the unfolded position. The auxiliary support includes an auxiliary bar that is disposed between the first and second mounting assemblies in a first direction of the foldable table and coupled with the first and second mounting assemblies. The auxiliary bar is elongated in a second direction of the foldable table that is substantially perpendicular to the first direction. The auxiliary support also includes one or more linking assemblies, each coupled with a proximal side of the first panel and a proximal side of the second panel. The auxiliary support further includes a third leg assembly connected with the auxiliary bar. When the first and second panels are in the unfolded position, each of the one or more linking assemblies abuts the auxiliary bar toward the first and second panels, thereby providing support to the proximal sides of the first and second panels and enhancing stability of the foldable table at the proximal sides of the first and second panels. When the first and second panels are in the folded position, the first mounting assembly, the second mounting assembly, the first leg assembly, the second leg assembly and the third leg assembly are disposed between the first and second panels.

The auxiliary supports and foldable tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1:
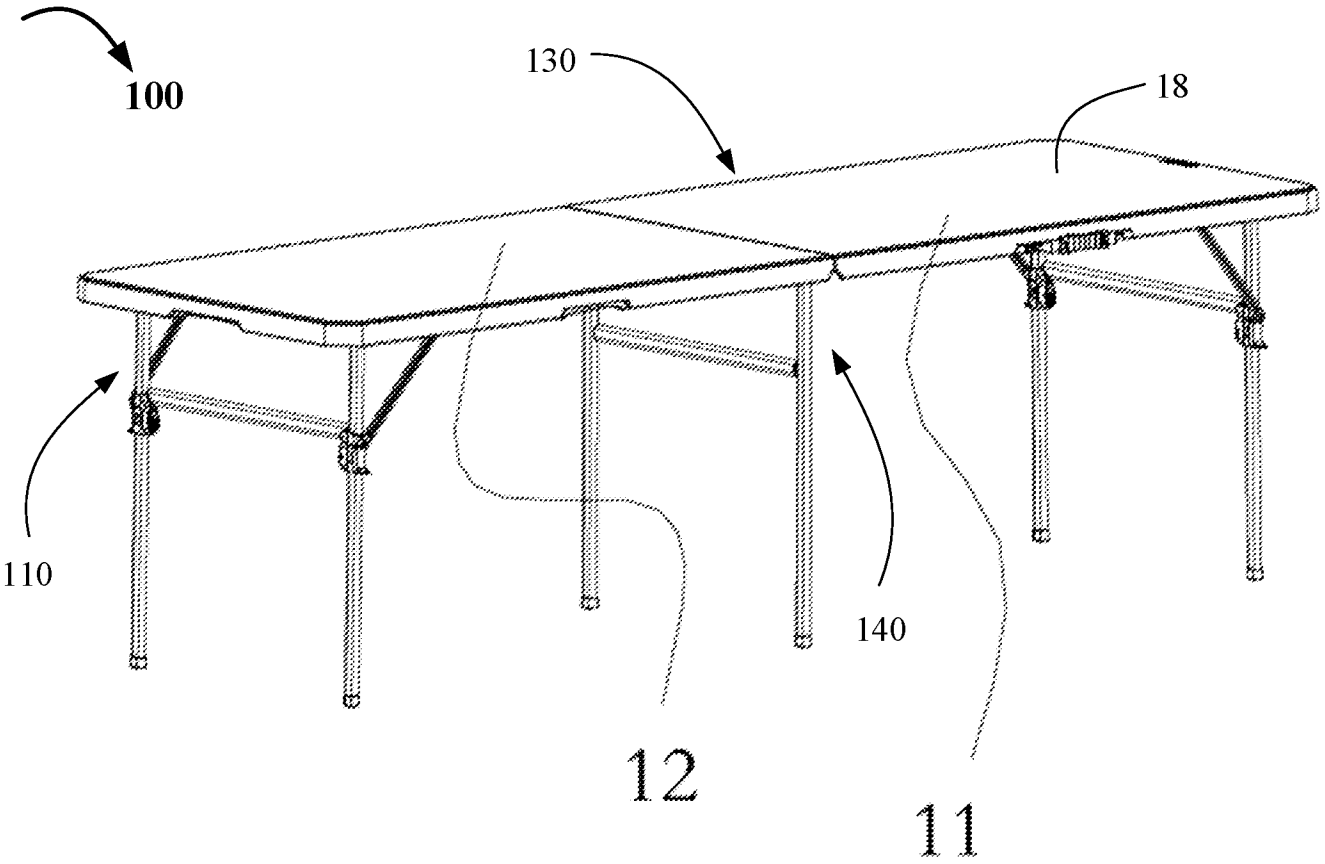
FIG. 1 is a top perspective view illustrating an exemplary foldable table in an unfolded state in accordance with some exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of foldable tables with auxiliary supports. Generally, a foldable table includes a supporting frame, a tabletop and an auxiliary support. The supporting frame includes first and second mounting assemblies pivotally connected to each other at their proximal sides. The tabletop includes a first panel coupled with the first mounting assembly and a second panel coupled with the second mounting assembly such that the first and second panels are rotatable with respect to each other between a folded position and an unfolded position. The auxiliary support includes an auxiliary bar disposed between and coupled with the first and second mounting assemblies. The auxiliary support also includes one or more linking assemblies, each coupled with the first and second panels. When the first and second panels are in the unfolded position, each of the one or more linking assemblies abuts the auxiliary bar toward the first and second panels. As such, the auxiliary support helps support the first and second panels or prevent the proximal sides of the first and second panels from warping, sagging, dislocation or misalignment.

Referring now to FIGS. 1-4 and 7-8, there is depicted exemplary foldable table 100 in accordance with some exemplary embodiments of the present disclosure. As shown, foldable table 100 includes a supporting frame, such as supporting frame 110, and a tabletop, such as tabletop 130, coupled with the supporting frame. Foldable table 100 also includes an auxiliary support such as auxiliary support 140 configured to help stabilize the tabletop when the table is unfolded and in use.

Figure 2:
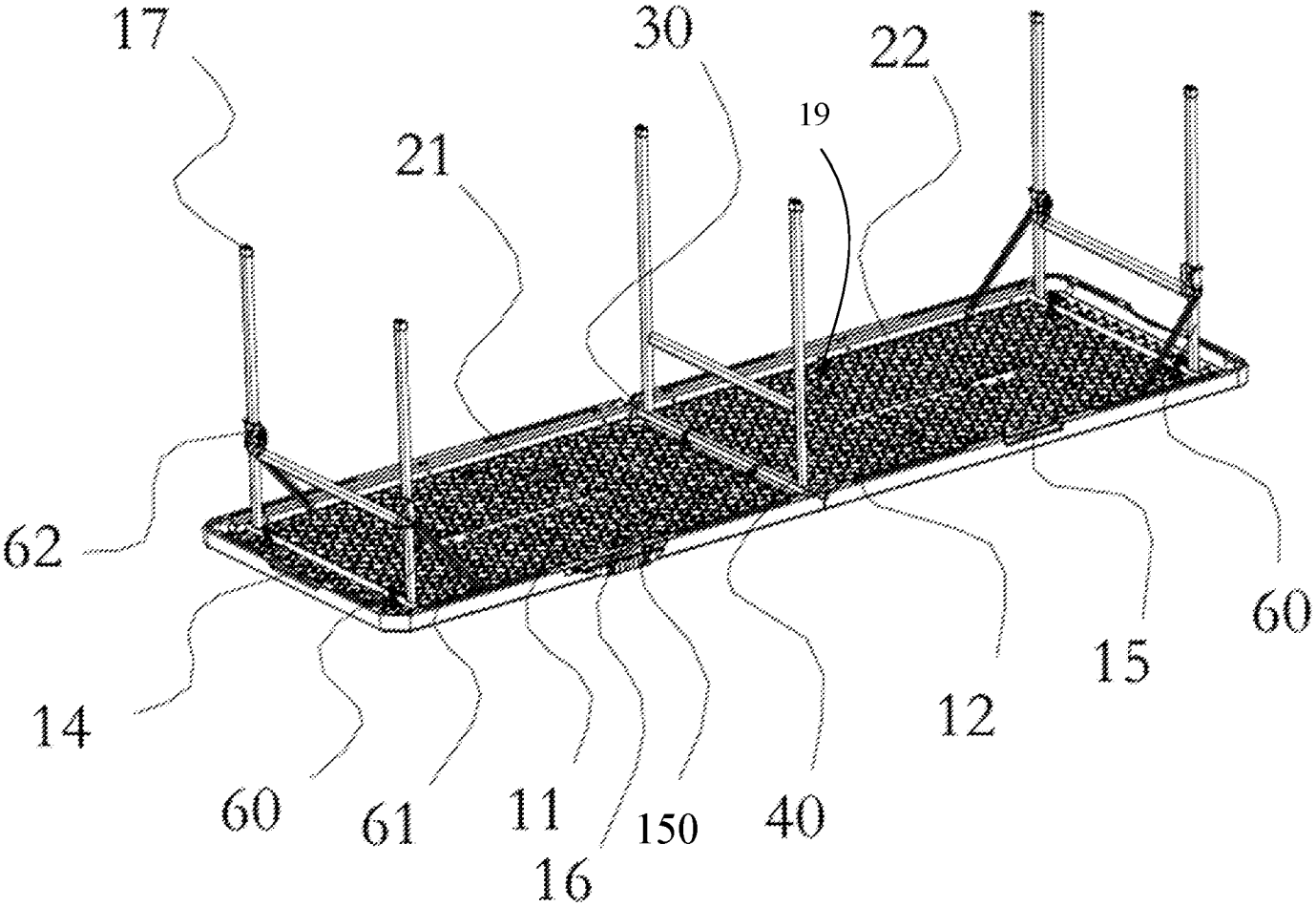
FIG. 2 is a bottom perspective view illustrating the exemplary foldable table of FIG. 1.
Figure 3:
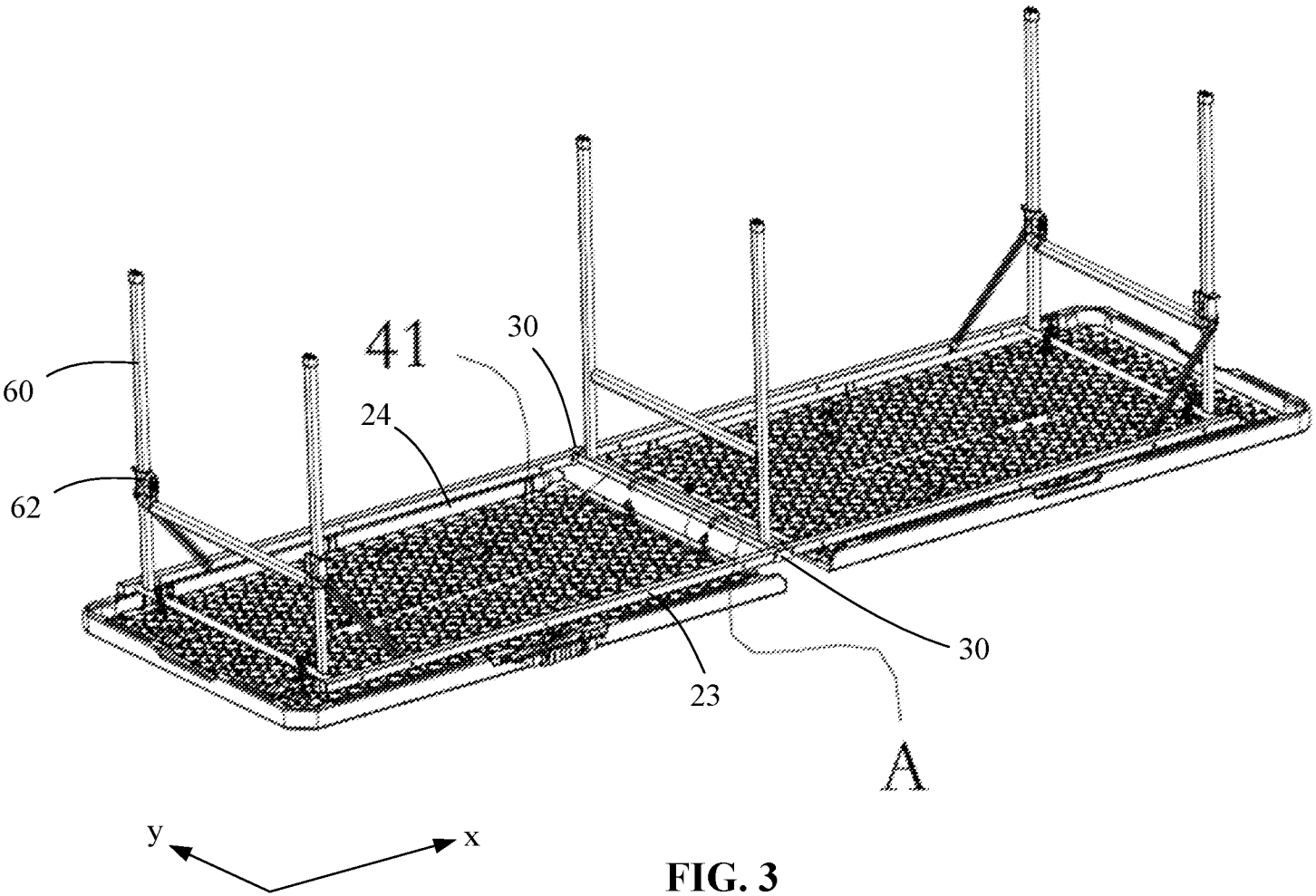
FIG. 3 is a bottom perspective and partially disassembled view illustrating the exemplary foldable table of FIG. 1.
Figure 4:
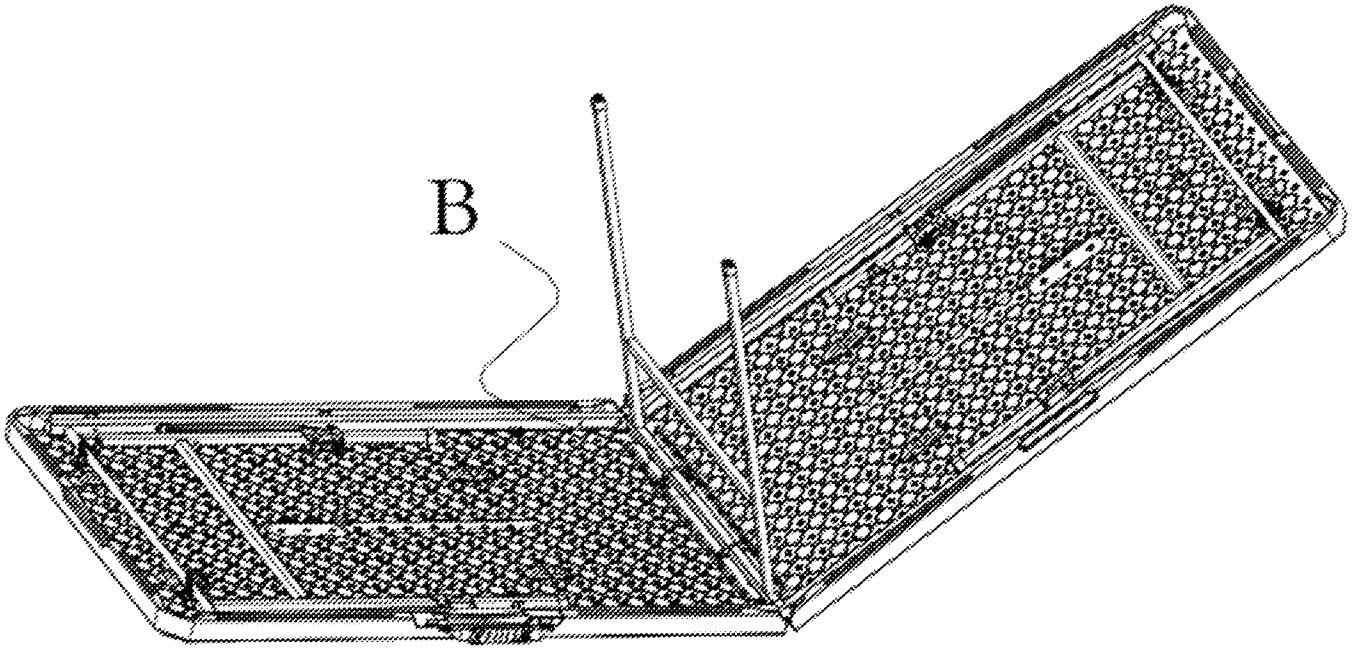
FIG. 4 is a bottom perspective view illustrating the exemplary foldable table of FIG. 1 in an intermediate state between folded and unfolded states.

Examples of supporting frames are disposed in U.S. patent application Ser. No. 17/142,711 and U.S. patent application Ser. No. 16/838,939, the disclosure of each application is incorporated herein for all purposes by reference in its entirety. In some exemplary embodiments, the supporting frame includes a first mounting assembly and a second mounting assembly, which can be but do not necessarily have to be identical or symmetric with respect to each other. By way of example, FIGS. 2-4 illustrate first mounting assembly 21 and second mounting assembly 22 that are substantially the same and disposed symmetrically with respect to each other.

The first and second mounting assemblies are pivotally connected with each other at their proximal sides. As used herein, the sides at which first and second mounting assemblies are connected to each other are referred to as their proximal sides, and the sides opposite the proximal sides are referred to as their distal sides. For instance, in FIG. 2, the proximal sides of first and second mounting assemblies are in the middle of the foldable table. The distal sides correspond to the left and right sides of the figure. It should be noted that the term "middle" as used herein does not necessarily mean the center of the frame, and the term "side" does not necessarily mean an outmost edge of the frame.

In some exemplary embodiments, each of the first and mounting assembles includes a first bar and a second bar, such as first bar 23 and second bar 24. The first and second bars generally elongated in a first or longitudinal direction (e.g., x-direction in FIG. 3) and spaced apart from each other in a second or lateral direction (e.g., y-direction in FIG. 3). A first leg assembly such as leg assembly 60 is connected to the first mounting assembly and rotatable with respect to the first panel. Similarly, a second leg assembly is connected to the second mounting assembly and rotatable with respect to the second panel. In some exemplary embodiments, a linking mechanism is provided to help control the rotation of the leg assembly and/or lock the leg assembly when the table is in use. In an exemplary embodiment, the linking mechanism includes a controller and linking piece, such as controller 62 and linking piece 61. Examples of linking mechanisms are disposed in U.S. patent application Ser. No. 16/838,947, the disclosure of the application is incorporated herein for all purposes by reference in its entirety.

In some exemplary embodiments, tabletop 130 includes a first panel coupled with the first mounting assembly and a second panel coupled with the second mounting assembly such that the first and second panels are rotatable with respect to each other between a folded position and an unfolded position. When the first and second panels are in the folded position, the mounting and leg assemblies are disposed between the first and second panels. The first and second panels can be but do not necessarily have to be identical or symmetric with respect to each other. By way of example, FIGS. 1-4 illustrate first panel 11 and second panel 12 that are substantially the same and disposed symmetrically with respect to each other. Each of the first and second panels has an upper side and a lower side, such as upper side 18 and lower side 19.

In some exemplary embodiments, each of the first and second panels is a unitary piece formed by blow molding plastics such as high density polyethylene (HDPE), low density polyethylene (LDPE), polypropylene (PP), polyvinyl chloride (PVC), polyethylene terephthalate (PET), thermoplastic elastomers (TPE), or the like. The panel generally includes a first panel wall, a second panel wall and a generally hollow interior formed between the first and second panel walls. The panel can be of various regular or irregular shapes, including but not limited to a square shape, a half circular shape or a rectangular shape. The panel can have other features, such as depressions, ridges, or the like, monolithically formed with the first and/or second panel walls.

The auxiliary support, such as auxiliary support 140, is configured to assist in supporting and stabilizing the first and second panels when they are in the unfolded position. In some exemplary embodiments, the auxiliary support includes an auxiliary bar, such as auxiliary bar 41. The auxiliary bar is disposed between the first and second mounting assemblies in the first direction of the foldable table (e.g., x-direction in FIG. 3) and elongated in the second direction of the foldable table (e.g., y-direction in FIG. 3). In some exemplary embodiments, the second direction is substantially perpendicular to the first direction.

The auxiliary bar can be solid or hollow (e.g., a tube), and can be made of various materials including but not limited to metals and plastics. Cross-sectional-wise, the auxiliary bar can have various regular or irregular shapes, including but not limited to rectangular, square, circular, oblong or oval shape. For instance, in an exemplary embodiment, the auxiliary bar has a substantially circular cross section. In some exemplary embodiments, the auxiliary bar has a substantially rectangular cross section.

Figure 11:
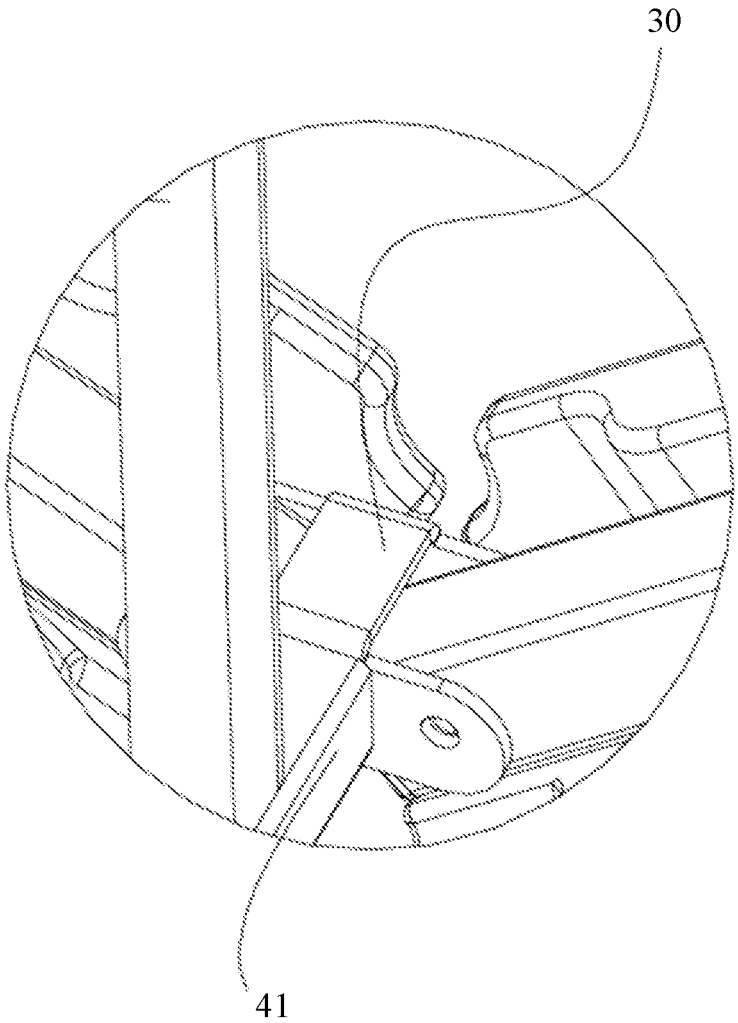
FIG. 11 is an enlarged view taken along circle E of FIG. 8.

The auxiliary bar is coupled with the first and second mounting assemblies. For instance, in some exemplary embodiments, the first bars of the first and second mounting assemblies are disposed at a first side of foldable table and pivotally connected with each other by a first connector, such as connector 30 as illustrated in as illustrated in FIGS. 3 and 11, at the first side of the foldable table. The second bars of the first and second mounting assemblies are disposed at a second side of foldable table and pivotally connected with each other by a second connector, such as connector 30, at the second side of the foldable table. The auxiliary bar has a first end fixedly coupled with the first connector and a second end fixedly coupled with the second connector.

In some exemplary embodiments, the auxiliary support includes a third leg assembly, such as leg assembly 40. The third assembly is coupled with the auxiliary bar. In some exemplary embodiments, wherein when the first and second panels are in the folded position, the first mounting assembly, the second mounting assembly, the first leg assembly, the second leg assembly and the third leg assembly are disposed between the first and second panels.

In some exemplary embodiments, the auxiliary support also includes one or more linking assemblies, such as linking assembly 150. The auxiliary support can include any suitable number of linking assemblies. For instances, in an exemplary embodiment, the auxiliary support includes a single linking assembly. In another exemplary embodiment, the auxiliary support includes 2, 3, 4, or more than 4 linking assemblies. As a non-limiting example, FIGS. 2-4 illustrate two linking assemblies spaced apart along the second direction of the foldable table. Each of the one or more assemblies is coupled with a proximal side of the first panel and a proximal side of the second panel.

When the first and second panels are in the unfolded position, each of the one or more linking assemblies abuts the auxiliary bar toward the first and second panels, and thus provides support to the proximal sides of the first and second panels and enhances stability of the foldable table at the proximal sides of the first and second panels. In addition, the auxiliary support helps align the first and second panels with respect to each other. It reduces warping, sagging, dislocation and/or misalignment at the proximal sides of the first and second panels, prevents the occurrence of a gap or height difference between the first and second panels, and improves the appearance and safety of the table.

Figure 5:
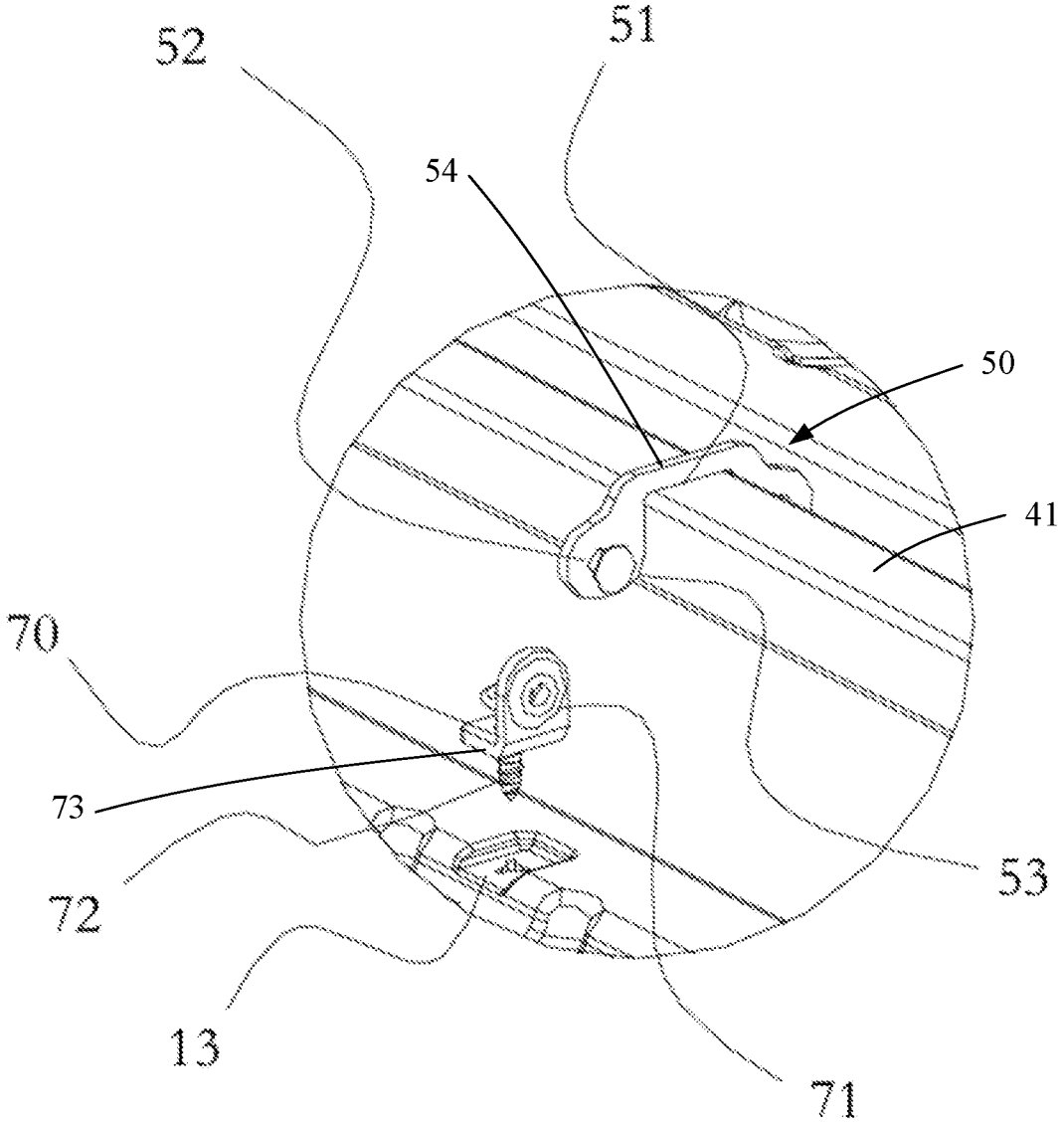
FIG. 5 is an enlarged view taken along circle A of FIG. 3.
Figure 6:
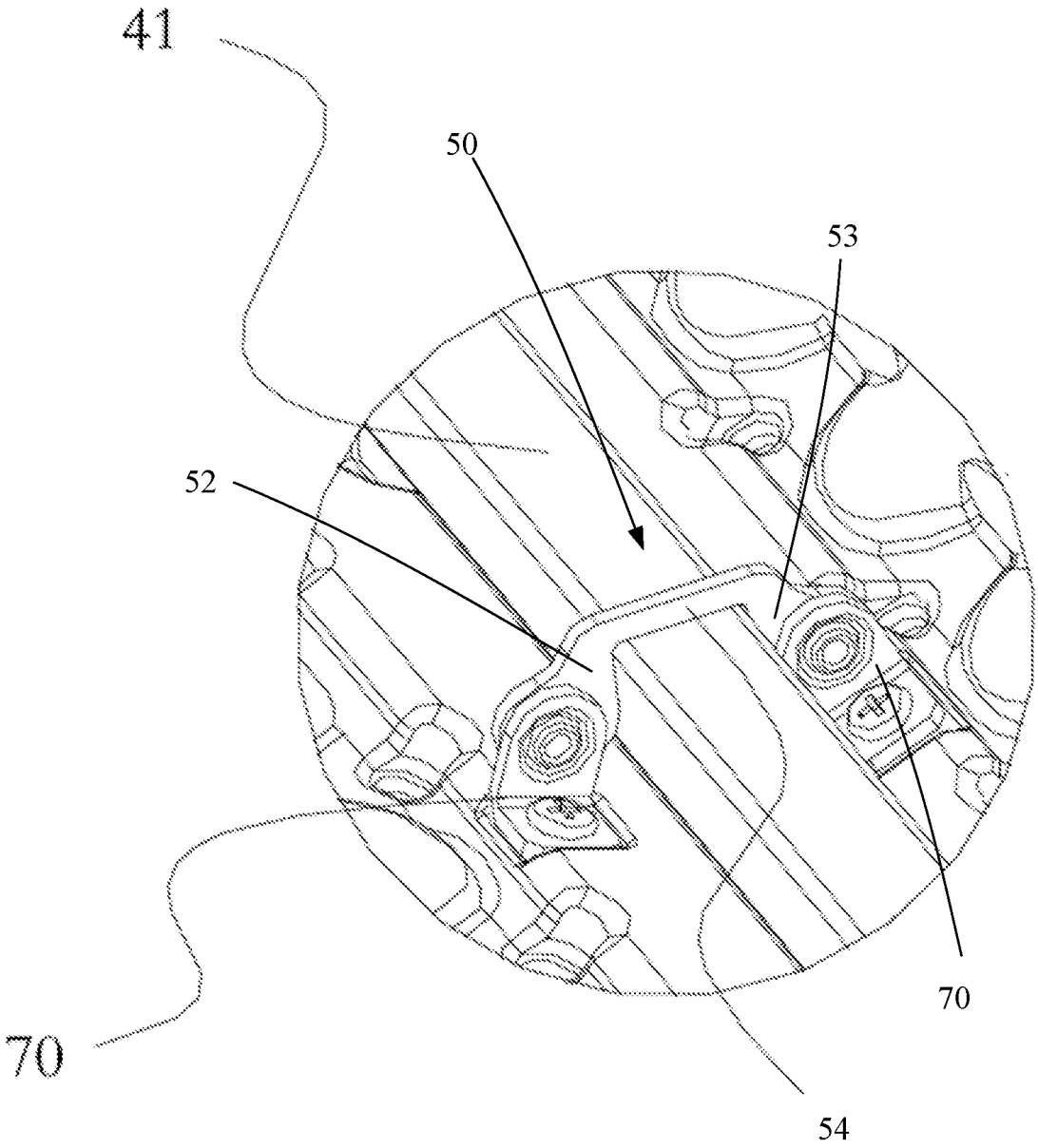
FIG. 6 is an enlarged view taken along circle B of FIG. 4.
Figure 7:
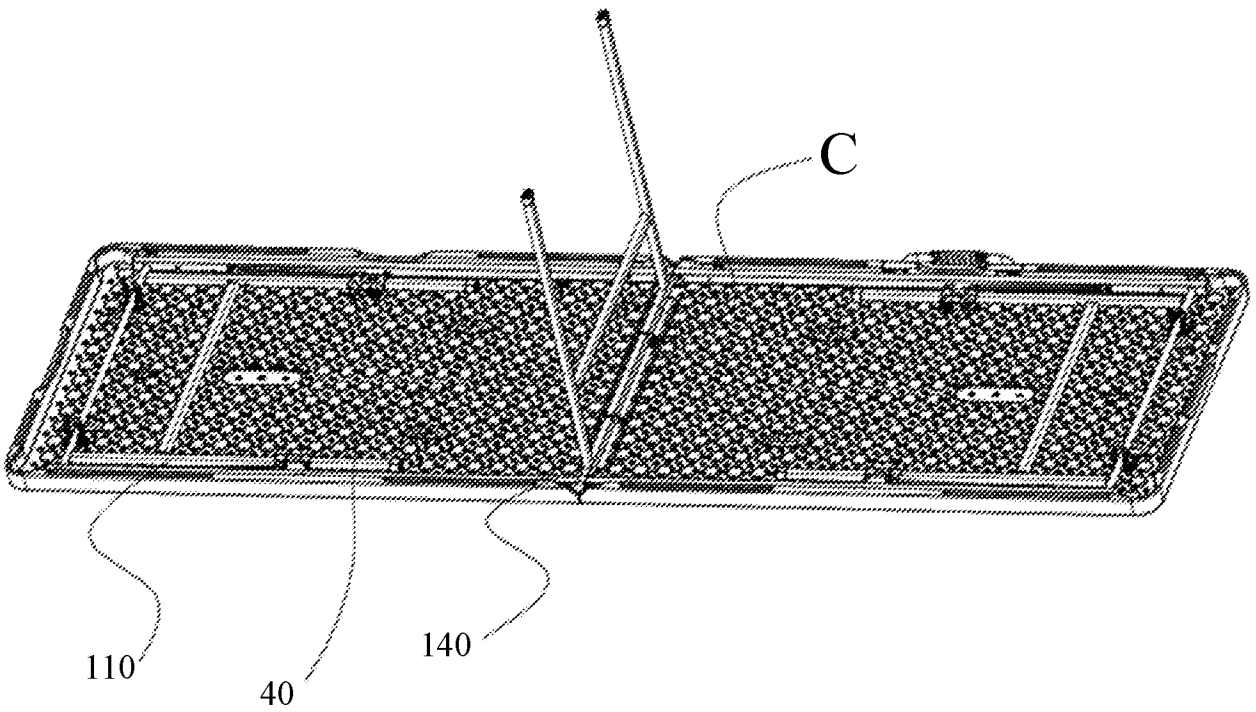
FIG. 7 is a bottom perspective view illustrating an exemplary foldable table in an intermediate state between folded and unfolded states in accordance with some exemplary embodiments of the present disclosure.

For instance, referring to FIGS. 5-6 and 9-10, in some exemplary embodiments, linking assembly 150 includes first, second and third linking pieces, such as linking piece 70 at the left-hand side of FIG. 6, linking piece 70 at the right-hand side of FIG. 6, and linking piece 50. The first linking piece is fixedly coupled with the proximal side of the first panel, for instance, by a fastener, such as fastener 72 illustrated in FIG. 5. Similarly, the second linking piece is fixedly coupled with the proximal side of the second panel. The third linking piece is disposed between the first and second linking pieces and pivotally connected with first and second linking pieces.

In some exemplary embodiments, the third linking pieces includes first, second and third portions, such as first portion 52, second portion 53 and third portion 54. The first portion of the third linking piece is pivotally coupled with the first linking piece. The second portion of the third linking piece is pivotally coupled with the second linking piece. The third portion of the third linking piece is disposed between the first and second portion of the third linking piece. In some exemplary embodiments, the third portion of the third linking piece abuts the auxiliary bar toward the first and second panels when the first and second panels are in the unfolded position.

In some exemplary embodiments, the first, second and third linking pieces collectively form a receptacle, such as receptacle 51, as illustrated in FIGS. 5-6 and 9-10. The receptacle receives, cross-sectional-wise, a portion of the auxiliary bar. In some exemplary embodiments, an edge, such as edge 53, adjacent to an opening of the receptacle is curved outwardly. The outwardly curved edge makes it easy to couple each of the linking assemblies with the auxiliary bar, e.g., easy for each of the linking assemblies to receive, cross-sectional-wise, a portion of the auxiliary bar. Additionally, the outwardly curved edge allows smooth folding and unfolding of the first and second panels.

In some exemplary embodiments, cross-sectional-wise, the receptacle has a shape corresponding to the shape of the auxiliary bar. For instance, in the illustrated embodiment, the cross-section of the auxiliary bar is substantially rectangular, and accordingly the bottom of the receptacle is substantially flat. It should be noted that this is a non-limiting example. The cross-section of the auxiliary bar can have other shapes including but not limited to circular, oval, or oblong shapes, and the receptacle can have other shapes corresponding to the shape of the cross-section of the auxiliary bar.

In some exemplary embodiments, linking piece 70 includes a first portion and a second portion, such as portion 73 and portion 71 illustrated in FIG. 5. The first portion is fixedly connected to the first or second panel, and the second portion is pivotally connected to the first or second portion of the third linking piece. In an exemplary embodiment, portion 71 and portion 73 of linking piece 70 are substantially perpendicular to each other, for instance, made by bending a metal piece. In some exemplary embodiments, portion 73 of linking piece 70 is fixedly connected to the first or second panel, for instance, by a fastener such as fastener 72. In some exemplary embodiments, the first or second panel includes a recess, such as recess 13. The recess is formed at the lower side of the first or second panel to receive portion 73 of linking piece 70.

Figure 8:
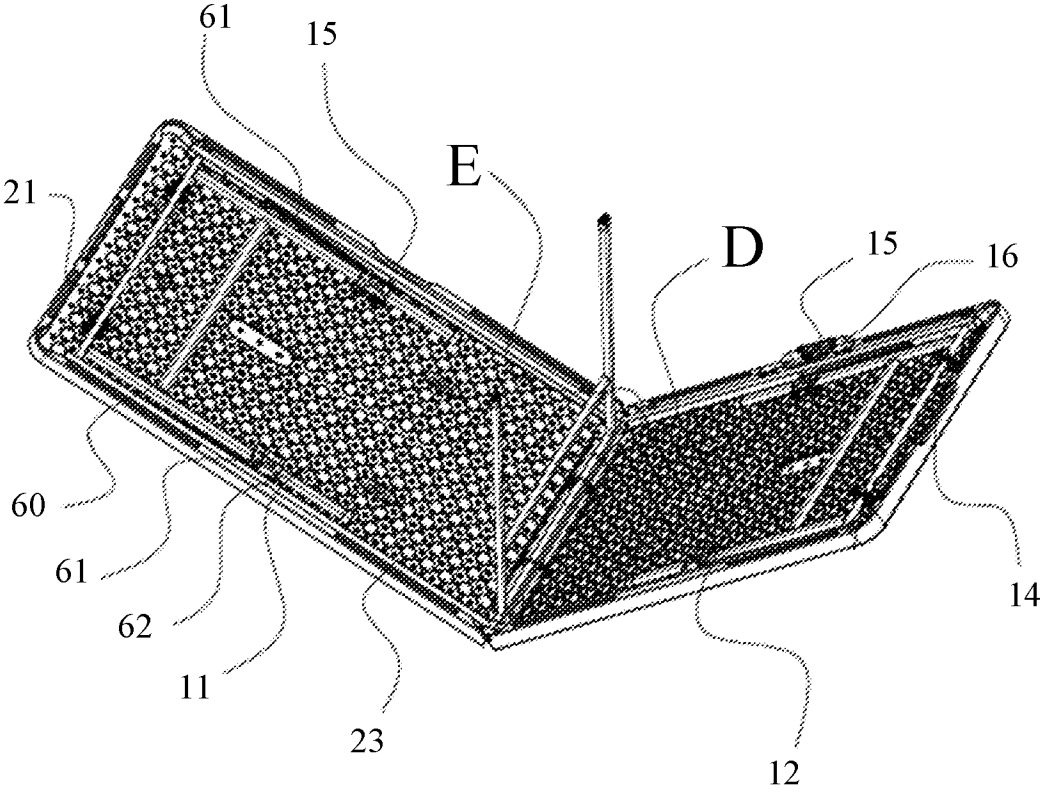
FIG. 8 is a bottom perspective view illustrating the exemplary foldable table of FIG. 7 in another intermediate state between folded and unfolded states.
Figure 9:
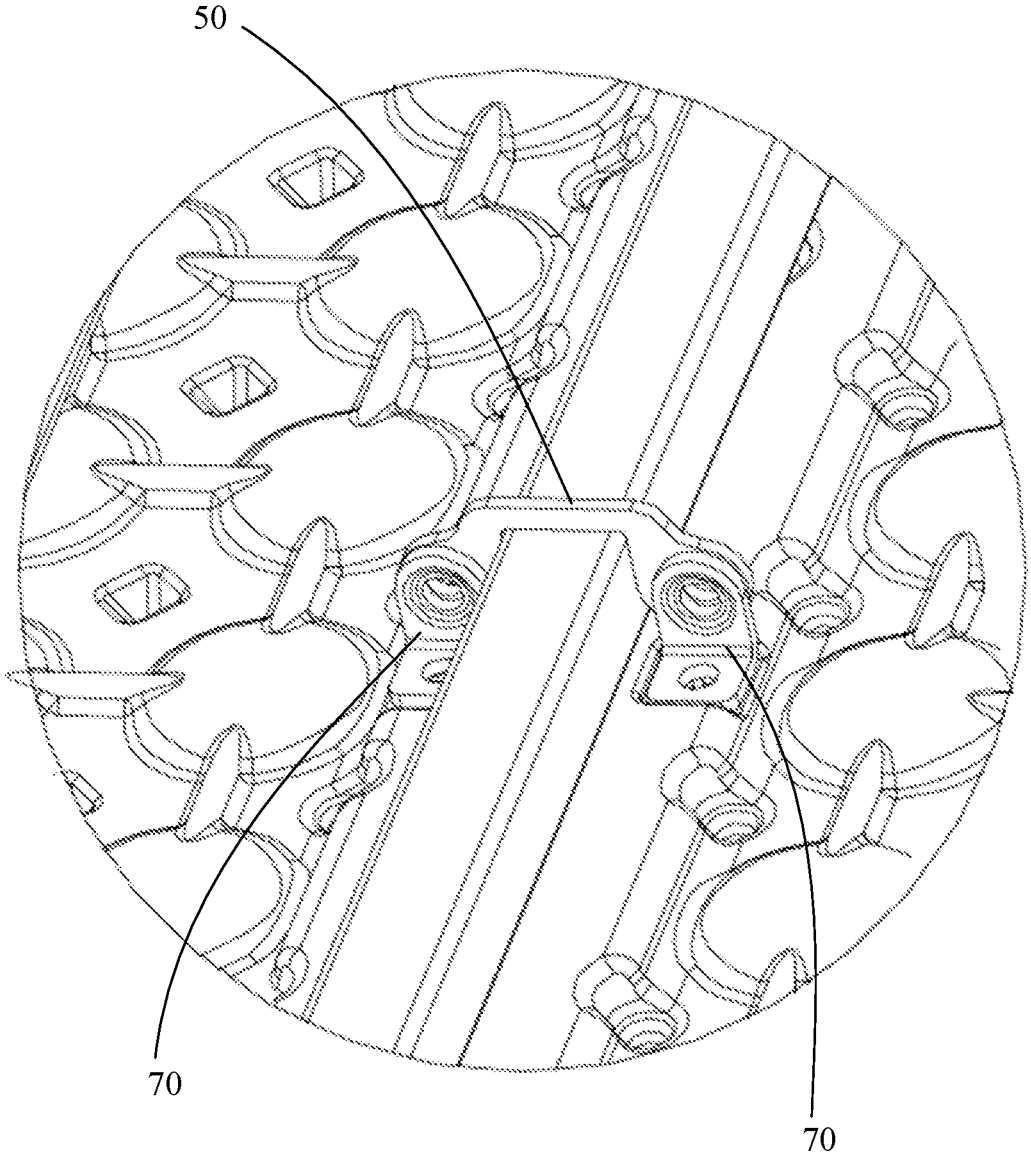
FIG. 9 is an enlarged view taken along circle C of FIG. 7.
Figure 10:
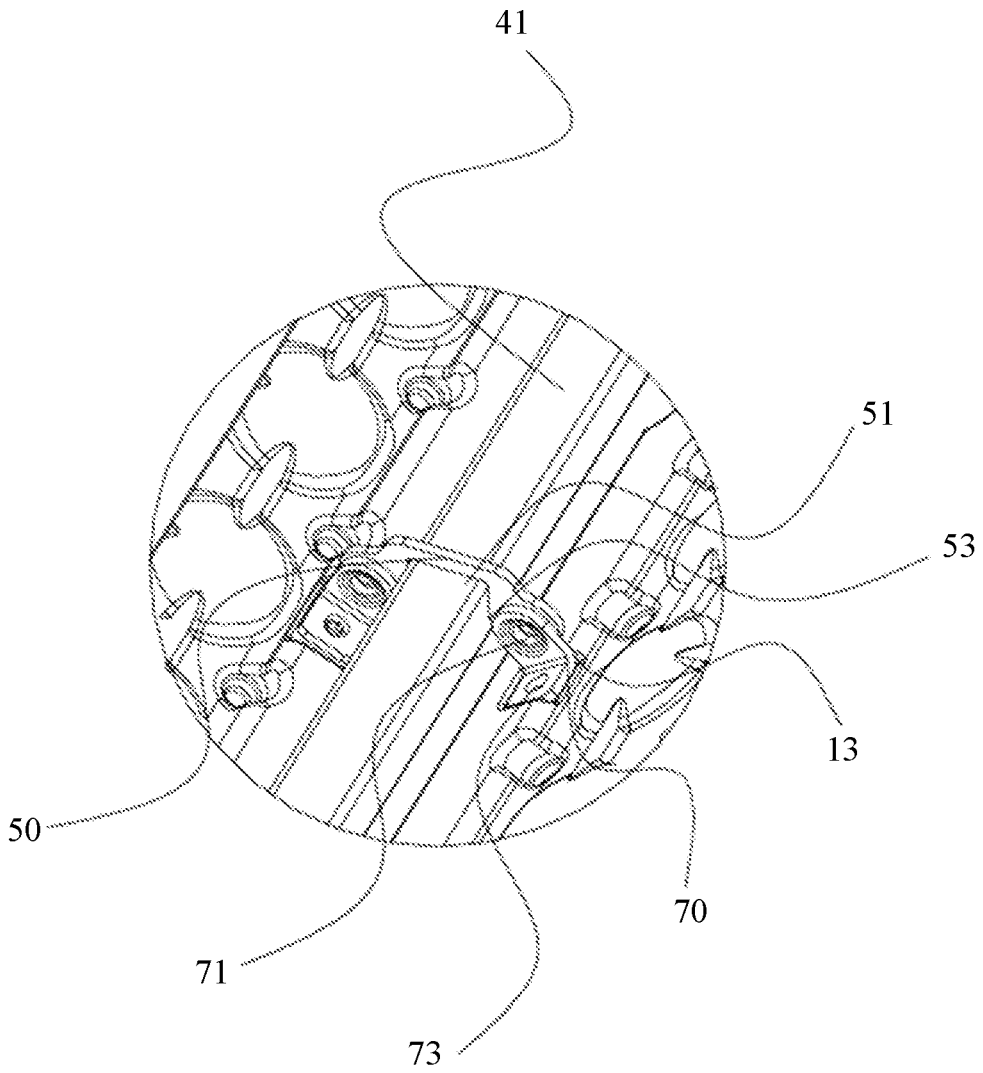
FIG. 10 is an enlarged view taken along circle D of FIG. 8.

In some exemplary embodiments, the foldable table includes a handle, such as handle 16, to facilitate carrying of the foldable table. The handle can be connected to the supporting frame or connected to the tabletop. By way of example, FIG. 2 illustrates the handle connected to the first panel of the tabletop at a side of the first panel. In some exemplary embodiments, a notch, such as notch 15, is formed at a side of the second panel. When the first and second panels are in the folded position, the handle and the second notch are adjacent to each other. In an exemplary embodiment, a notch, corresponding to notch 15 at the second panel, is also formed at the first panel adjacent to where the handle is attached. In some exemplary embodiments, one or more notches are additionally or optionally formed at an edge or a lip of the tabletop. As a non-limiting example, FIGS. 2 and 8 illustrate a notch, such as notch 14, formed at a distal side of each of the first and second panels. When the first and second panels are in the folded position, notches 14 at the distal sides of the first and second panels face each other, and collectively form a gap to facilitate unfolding of the panels with hands or the like. Examples of handles and notches are disposed in U.S. patent application Ser. No. 17/246,038, the disclosure of the application is incorporated herein for all purposes by reference in its entirety.

The foldable tables disclosed herein can include additional, optional or alternative features. For instance, in some exemplary embodiments, one or more anti-slip element, such as pad 17, is provided at the bottom of the leg assembly.

The foldable tables of the present disclosure are easy to use. For instance, to fold the table, one can operate (e.g., press or the like) controller 62 to unlock the first and second leg assemblies, rotate the first leg assembly toward the first panel, and rotate the second leg assembly toward the second panel. Then, one can rotate the first panel (along with the first leg assembly) and the second panel (along with the second leg assembly) toward each other. This results in a compact folded table, with the first mounting assembly, the second mounting assembly, the first leg assembly, the second leg assembly and the third leg assembly are disposed between the first and second panels. The handle allows one to carry around the folded table. To unfold the table, one can grasp the first and second panels, for instance, through the gap formed by notches 14, and then rotate the first and second panels away from each other. Afterwards, one can unfold the first and second leg assemblies to finish the setup.

The foldable tables of the present disclosure have several advantages. For instance, with the first and second panels, a foldable table of the present disclosure can be relatively large when unfolded and thus can accommodate more people when needed. With the auxiliary support, the foldable table of the present disclosure is more stable and safer when in use. With a gap formed by notches, unfolding of the table is easy, simple and smooth. The table is compact when unfolded. With a handle, the folded table is easy to carry around.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first portion could be termed a second portion, and, similarly, a second portion could be termed a first portion, without changing the meaning of the description, so long as all occurrences of the "first portion" are renamed consistently and all occurrences of the "second portion" are renamed consistently.

What is claimed is:

1. A foldable table comprising:

a tabletop comprising a first panel and a second panel, wherein each of the first and second panels comprises an upper side and a lower side;

a supporting frame to support the first and second panel, the supporting frame comprising:

a first mounting assembly connected to the lower side of the first panel; and a second mounting assembly connected to the lower side of the second panel, wherein the first and second mounting assemblies are pivotally coupled with each other at proximal sides thereof such that the first and second panels are rotatable with respect to each other between a folded position and an unfolded position; and an auxiliary support configured to assist in supporting and stabilizing the first and second panels when they are in the unfolded position, the auxiliary support comprising:

an auxiliary bar disposed between the first and second mounting assemblies in a first direction of the foldable table, and coupled with the first and second mounting assemblies, wherein the auxiliary bar is elongated in a second direction of the foldable table that is substantially perpendicular to the first direction; and one or more linking assemblies, wherein each of the one or more linking assemblies comprises:

a first linking piece fixedly coupled with the proximal side of the first panel;

a second linking piece fixedly coupled with the proximal side of the second panel; and a third linking piece comprising a first portion pivotally coupled with the first linking piece, a second portion pivotally coupled with the second linking piece, and a third portion between the first and second portion;

wherein when the first and second panels are in the unfolded position, the first, second and third linking pieces collectively form a receptacle to receive, cross-sectional-wise, a portion of the auxiliary bar, thereby enhancing stability of the foldable table at the proximal sides of the first and second panels.

2. The foldable table of claim 1, wherein:

each of the first and second mounting assemblies comprises a first mounting bar disposed at a first side of the foldable table and a second mounting bar disposed at a second side of the foldable table;

the first mounting bars of the first and second mounting assemblies are pivotally coupled with each other at proximal ends thereof by a first connector;

the second mounting bars of the first and second mounting assemblies are pivotally coupled with each other at proximal ends thereof by a second connector; and the auxiliary bar has a first end fixedly coupled with the first connector and a second end fixedly coupled with the second connector.

3. The foldable table of claim 1, wherein the supporting frame further comprises:

a first leg assembly connected with the first mounting assembly; and a second leg assembly connected with the second mounting assembly, wherein when the first and second panels are in the folded position, the first and second leg assemblies and the first and second mounting assemblies are disposed between the first and second panels.

4. The foldable table of claim 1, wherein the one or more linking assemblies comprise a first linking assembly and a second linking assembly spaced apart along the second direction of the foldable table.

5. The foldable table of claim 1, wherein a bottom of the receptacle is substantially flat.

6. The foldable table of claim 1, wherein an edge adjacent to an opening of the receptacle is curved outwardly.

7. The foldable table of claim 1, wherein a respective linking piece in the first and second linking pieces comprises a fourth portion fixedly connected to a corresponding panel in the first and second panels, and a fifth portion pivotally connected to a corresponding portion in the first and second portions of the third linking piece.

8. The foldable table of claim 7, wherein the fourth portion of the respective linking piece is fixedly connected to the corresponding panel by a fastener.

9. The foldable table of claim 7, wherein the corresponding panel comprises a recess at the lower side thereof to receive the fourth portion of the respective linking piece.

10. The foldable table of claim 7, wherein the fourth and fifth portions of the respective piece are substantially perpendicular to each other.

11. The foldable table of claim 1, wherein a cross-section of the auxiliary bar is substantially rectangular.

12. The foldable table of claim 1, wherein the auxiliary support further comprises a third leg assembly coupled with the auxiliary bar of the auxiliary support, wherein when the first and second panels are in the unfolded position, the third leg assembly provides support to the first and second panels, and wherein when the first and second panels are in the folded position, the third leg assembly is disposed between the first and second panels.

13. The foldable table of claim 1, wherein each of the first and second panels comprises a first notch formed at a distal side thereof, wherein when the first and second panels are in the folded position, the first notches of the first and second panels face each other and collectively form a gap.

14. The foldable table of claim 1, further comprising a handle connected to the supporting frame or tabletop to facilitate carrying of the foldable table.

15. The foldable table of claim 14, wherein the handle is connected to a side of the first panel, and a second notch is formed at a side of the second panel, wherein when the first and second panels are in the folded position, the handle and the second notch are adjacent to each other.

16. A foldable table comprising:

a tabletop comprises a first panel and a second panel, wherein each of the first and second panels comprises an upper side and a lower side;

a supporting frame to support the first and second panel, the supporting frame comprising:

a first mounting assembly connected to the lower side of the first panel; and a second mounting assembly connected to the lower side of the second panel, wherein the first and second mounting assemblies are pivotally coupled with each other at proximal sides thereof such that the first and second panels are rotatable with respect to each other between a folded position and an unfolded position; and an auxiliary support configured to assist in supporting and stabilizing the first and second panels when they are in the unfolded position, the auxiliary support comprising:

an auxiliary bar disposed between the first and second mounting assemblies in a first direction of the foldable table, wherein the auxiliary bar is elongated in a second direction of the foldable table that is substantially perpendicular to the first direction, and has a first end coupled with the first and second mounting assemblies at a first side of the foldable table and a second end coupled with the first and second mounting assemblies at a second side of the foldable table; and a first linking assembly and a second linking assembly, each spaced apart from both the first and second ends of the auxiliary bar in the second direction of the foldable table, wherein each of the first and second linking assemblies is coupled with a proximal side of the first panel and a proximal side of the second panel;

wherein when the first and second panels are in the unfolded position, each of the first and second linking assemblies forms a receptacle to receive, cross-sectional-wise, a portion of the auxiliary bar, thereby enhancing stability of the foldable table at the proximal sides of the first and second panels.

17. The foldable table of claim 16, wherein:

each of the first and second mounting assemblies comprises a first mounting bar disposed at the first side of the foldable table and a second mounting bar disposed at the second side of the foldable table;

the first mounting bars of the first and second mounting assemblies are pivotally coupled with each other at proximal ends thereof by a first connector;

the second mounting bars of the first and second mounting assemblies are pivotally coupled with each other at proximal ends thereof by a second connector; and the auxiliary bar has the first end fixedly coupled with the first connector and the second end fixedly coupled with the second connector.

18. The foldable table of claim 16, wherein each of the first and second linking assemblies comprises a first linking piece fixedly coupled with the proximal side of the first panel and a second linking piece fixedly coupled with the proximal side of the second panel.

19. A foldable table comprising:

a tabletop comprises a first panel and a second panel, wherein each of the first and second panels comprises an upper side and a lower side;

a supporting frame to support the first and second panel, the supporting frame comprising:

a first mounting assembly connected to the lower side of the first panel;

a second mounting assembly connected to the lower side of the second panel, wherein the first and second mounting assemblies are pivotally coupled with each other at proximal sides thereof such that the first and second panels are rotatable with respect to each other between a folded position and an unfolded position;

a first leg assembly connected with the first mounting assembly; and a second leg assembly connected with the second mounting assembly; and an auxiliary support configured to assist in supporting and stabilizing the first and second panels when they are in the unfolded position, the auxiliary support comprising:

an auxiliary bar disposed between the first and second mounting assemblies in a first direction of the foldable table, wherein the auxiliary bar is elongated in a second direction of the foldable table that is substantially perpendicular to the first direction, and has a first end coupled with the first and second mounting assemblies at a first side of the foldable table and a second end coupled with the first and second mounting assemblies at a second side of the foldable table;

one or more linking assemblies, each spaced apart from both the first and second ends of the auxiliary bar in the second direction of the foldable table and each coupled with a proximal side of the first panel and a proximal side of the second panel; and a third leg assembly connected with the auxiliary bar;

wherein when the first and second panels are in the unfolded position, each of the one or more linking assemblies forms a receptacle to receive, cross-sectional-wise, a portion of the auxiliary bar, thereby enhancing stability of the foldable table at the proximal sides of the first and second panels; and wherein when the first and second panels are in the folded position, the first mounting assembly, the second mounting assembly, the first leg assembly, the second leg assembly and the third leg assembly are disposed between the first and second panels.

20. The foldable table of claim 19, wherein each of the one or more linking assemblies comprises a first linking piece fixedly coupled with the proximal side of the first panel and a second linking piece fixedly coupled with the proximal side of the second panel.

* * * * *